US008251496B2

(12) United States Patent
Hattori et al.

(10) Patent No.: US 8,251,496 B2
(45) Date of Patent: Aug. 28, 2012

(54) LIQUID DISCHARGE HEAD HAVING RESIN SUPPLY AND SUPPORT MEMBERS

(75) Inventors: Shozo Hattori, Tokyo (JP); Masashi Miyagawa, Yokohama (JP); Ryoichi Matsumoto, Tokyo (JP); Toshiaki Kaneko, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 360 days.

(21) Appl. No.: 12/596,923

(22) PCT Filed: May 21, 2009

(86) PCT No.: PCT/JP2009/059733
§ 371 (c)(1),
(2), (4) Date: Oct. 21, 2009

(87) PCT Pub. No.: WO2009/142331
PCT Pub. Date: Nov. 26, 2009

(65) Prior Publication Data

US 2011/0279547 A1 Nov. 17, 2011

(30) Foreign Application Priority Data

| | | |
|---|---|---|
| May 22, 2008 | (JP) | 2008-134315 |
| Jun. 30, 2008 | (JP) | 2008-170441 |
| Mar. 17, 2009 | (JP) | 2009-064299 |
| Mar. 26, 2009 | (JP) | 2009-076767 |

(51) Int. Cl.
*B41J 2/05* (2006.01)

(52) U.S. Cl. ..... 347/63; 347/56; 347/65

(58) Field of Classification Search ..... 347/20, 347/49, 50, 56–59, 61–65, 67, 84–87
See application file for complete search history.

(56) References Cited

U.S. PATENT DOCUMENTS

| | | | | |
|---|---|---|---|---|
| 5,216,446 | A * | 6/1993 | Satoi et al. | 347/65 |
| 5,560,090 | A | 10/1996 | Komakine et al. | |
| 5,808,641 | A | 9/1998 | Miyagawa et al. | |
| 6,180,018 | B1 | 1/2001 | Miyagawa et al. | |
| 6,257,703 | B1 | 7/2001 | Hirosawa et al. | |
| 6,511,162 | B1 | 1/2003 | Kashino et al. | |
| 6,663,229 | B2 | 12/2003 | Komuro et al. | |
| 6,960,424 | B2 | 11/2005 | Miyagawa et al. | |
| 2003/0052944 | A1 | 3/2003 | Scheffelin et al. | |
| 2007/0109372 | A1 * | 5/2007 | Tomioka et al. | 347/86 |
| 2008/0081867 | A1 * | 4/2008 | Sakata et al. | 524/451 |

FOREIGN PATENT DOCUMENTS

| | | |
|---|---|---|
| EP | 0 639 460 | 2/1995 |
| JP | 2007-276156 | 10/2007 |

OTHER PUBLICATIONS

International Preliminary Report on Patentability and Written Opinion of the Searching Authority dated Dec. 2, 2010, in International Application No. PCT/JP2009/059733.

* cited by examiner

*Primary Examiner* — Juanita D Jackson
(74) *Attorney, Agent, or Firm* — Fitzpatrick, Cella, Harper & Scinto

(57) ABSTRACT

The invention provides, between a discharge element substrate and a supply member, a support member containing a mixture that contains: a material having an affinity for a material forming the supply member; and another material.

16 Claims, 8 Drawing Sheets

LIQUID DISCHARGE HEAD HAVING RESIN SUPPLY AND SUPPORT MEMBERS

TECHNICAL FIELD

The present invention relates to a liquid discharge head that discharges a liquid and a manufacturing method of the liquid discharge head. The present invention specifically relates to an ink jet recording head that discharges ink onto a recording target medium to perform recording, and a manufacturing method of the ink jet recording head.

BACKGROUND ART

An example of using a liquid discharge head that discharges a liquid is an ink jet recording head for use in an ink jet recording method whereby ink is discharged onto a recording target medium to perform recording.

The ink jet recording head (recording head) has a substrate that at least includes: a plurality of discharge ports from which ink is discharged; a flow channel communicated with each discharge port; a supply port for supplying the ink to the flow channel; and an energy generating element for applying discharge energy to the ink in the flow channel. The recording head further has a support member that supports the substrate, an ink supply channel formation member that supplies the ink to the substrate, and the like. As the substrate, a substrate made of Si (silicon) is typically used. The ink supply channel formation member is made of a plastic or the like.

In such a recording head, there is conventionally the case where, due to a difference in linear expansion coefficient between a discharge element substrate provided with the energy generating element for discharging the liquid from the discharge port and an ink supply member for holding the liquid, a stress to a joint interface increases and as a result the discharge element substrate suffers warpage or contortion.

In such a case, a thermal stress occurs on the joint interface between the discharge element substrate and the ink supply member due to a temperature rise during recording and the like and causes the discharge element substrate to become deformed, as a result of which a recorded image can be affected.

To solve the above-mentioned problem, U.S. Pat. No. 6,257,703 describes a structure in which a support member having an equal linear expansion coefficient to the discharge element substrate is interposed between the discharge element substrate and the ink supply member. Moreover, Japanese Patent Application Laid-Open No. 2007-276156 discloses a method of molding a support member having an equal linear expansion coefficient to the discharge element substrate, integrally with the ink supply member.

However, required properties are different between a material used for the ink supply member and a material used for the support member. Therefore, even when the support member and the ink supply member are integrally formed, a favorable joint state cannot be attained, and there is a possibility that peeling or the like occurs between the support member and the supply member after molding and causes a decrease in liquid tightness. Hence there is a problem of needing to attain a state where the support member and the ink supply member are joined together with an extremely high affinity.

DISCLOSURE OF THE INVENTION

The present invention solves the problems in the conventional techniques mentioned above, and has an object of providing a liquid discharge head in which a support member for supporting a discharge element substrate and an ink supply member for supplying ink to the discharge element substrate are joined together with an extremely high affinity. The present invention also has an object of providing a method for manufacturing such a liquid discharge head efficiently and reproducibly.

According to an example of the present invention, it is possible to obtain a liquid discharge head in which a support member for supporting a discharge element substrate and an ink supply member for supplying ink to the discharge element substrate are joined together with an extremely high affinity. It is also possible to manufacture such a liquid discharge head efficiently and reproducibly.

Further features of the present invention will become apparent from the following description of exemplary embodiments with reference to the attached drawings.

BEST MODE FOR CARRYING OUT THE INVENTION

Figure 1A:
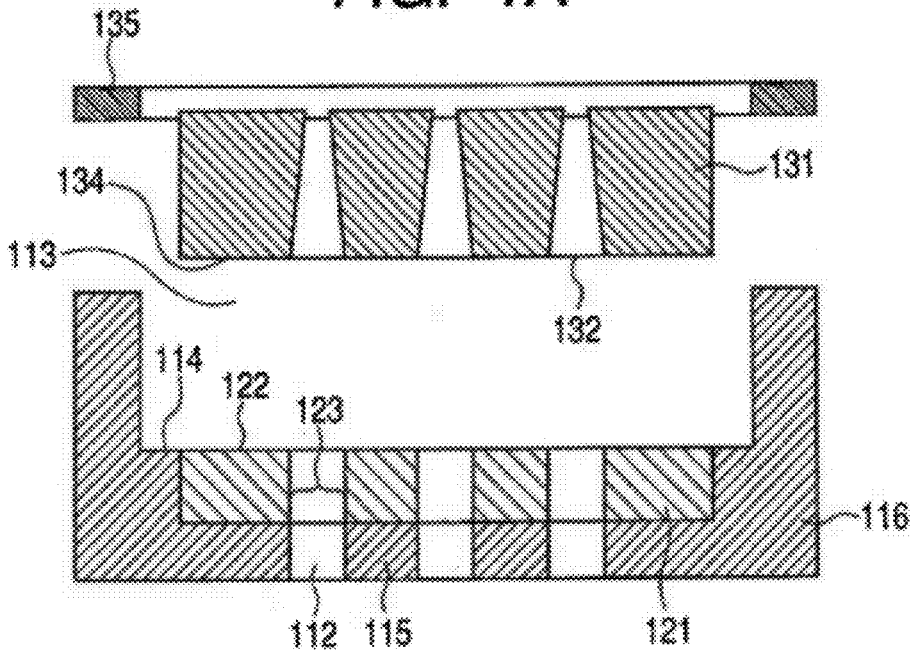
FIGS. 1A and 1B are schematic sectional views of one part of a recording head according to an embodiment of the present invention.

The following describes the present invention in detail, with reference to drawings.

In the following, structures having the same functions are given the same numerals in the drawings, and their description may be omitted.

Note that a liquid discharge head can be installed in apparatuses such as a printer, a copier, a facsimile having a communication system, and a word processor having a printer unit, as well as in industrial recording apparatuses combined with various processing apparatuses. The liquid discharge head can also be applied to discharging of a medicine and the like.

By using the liquid discharge head as a recording head, it is possible to perform recording onto various recording media such as paper, thread, fiber, fabric, leather, metal, plastic, glass, lumber, and ceramic.

The following describes the present invention using an ink jet recording head (recording head) as an example of the liquid discharge head.

Figure 3A:
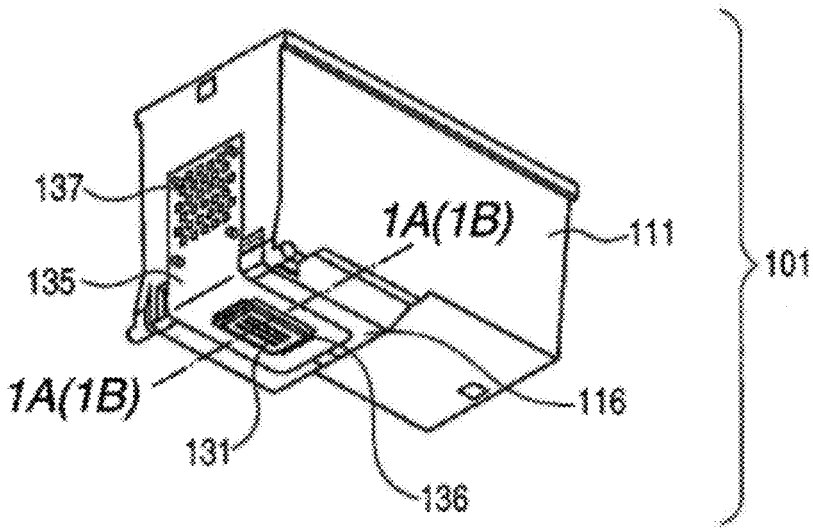
FIGS. 3A and 3B are schematic perspective views of one part of a recording head according to an embodiment of the present invention.
Figure 3B:
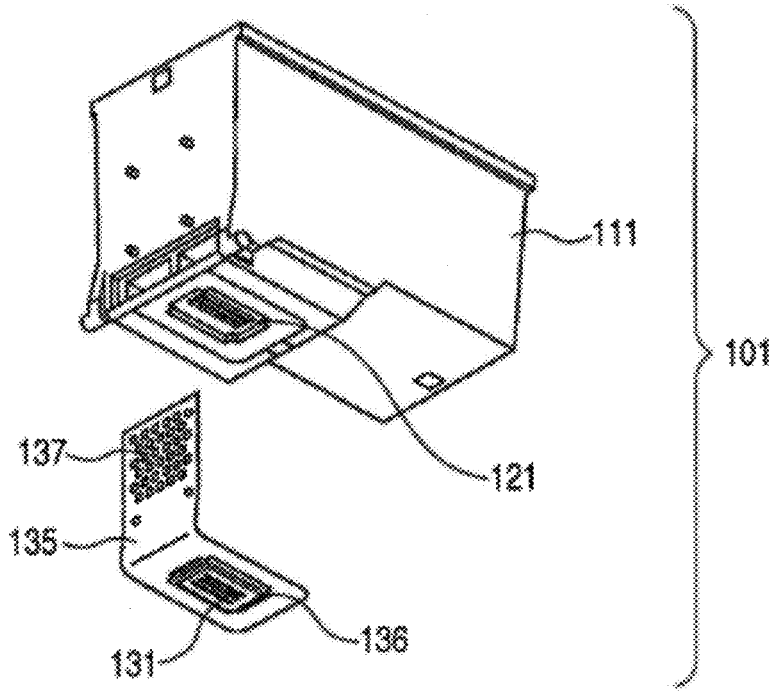

FIGS. 3A and 3B are perspective views illustrating a structure of an ink jet recording head which is an embodiment of the present invention. FIG. 3A illustrates an assembled recording head, and FIG. 3B illustrates a disassembled recording head.

As illustrated in each of FIGS. 3A and 3B, a recording head 101 includes a main body unit 111, a support member 121, a discharge element substrate 131, and a printed wiring substrate 135. In the main body unit 111, an ink supply member 116, an ink tank as a holding member for holding ink, and the support member 121 are integrally formed. The discharge element substrate 131 has an ink discharge port for discharging ink, and is disposed in a discharge element substrate housing unit 136 of the printed wiring substrate 135. The ink supply member 116 need not necessarily be formed integrally with the ink tank.

The printed wiring substrate 135 electrically connects the discharge element substrate 131 and a terminal unit 137, and supplies a drive control signal group from the terminal unit 137 to the discharge element substrate 131. For example, TAB (tape automated bonding) can be adopted for the connection between the printed wiring substrate 135 and the discharge element substrate 131.

Figure 2A:
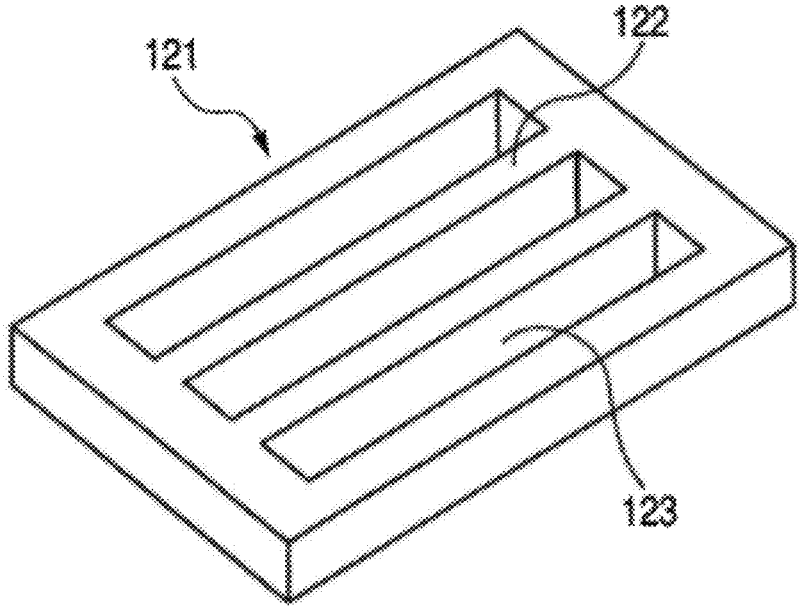
FIGS. 2A and 2B are schematic perspective views of one part of a recording head according to an embodiment of the present invention.
Figure 2B:
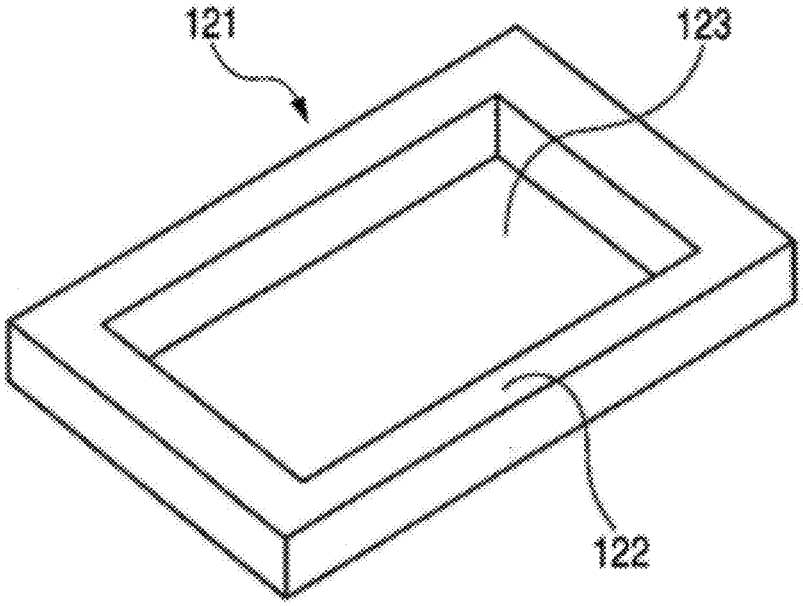

FIGS. 2A and 2B are perspective views of the support member 121. The support member 121 has an opening 123 which is communicated with an ink supply channel, and a joint surface 122 to which the discharge element substrate is joined. The case where a plurality of openings 123 is provided as illustrated in FIG. 2A and the case where one opening is provided as illustrated in FIG. 2B are exemplified here. A size of the opening 123 can be set appropriately.

Figure 1B:
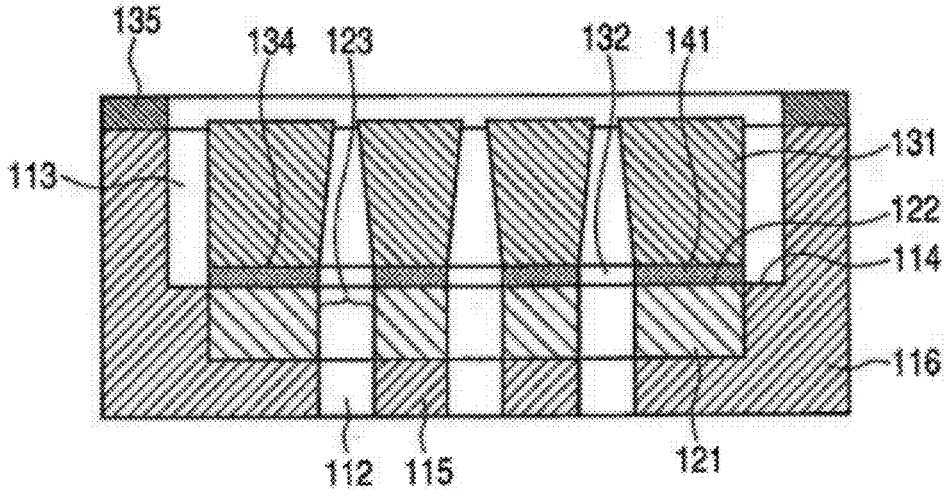

FIGS. 1A and 1B are a schematic sectional view illustrating one part of the recording head which is the first embodiment of the present invention, taken along line 1A(1B)-1A (1B) in FIG. 3A.

Figure 6:
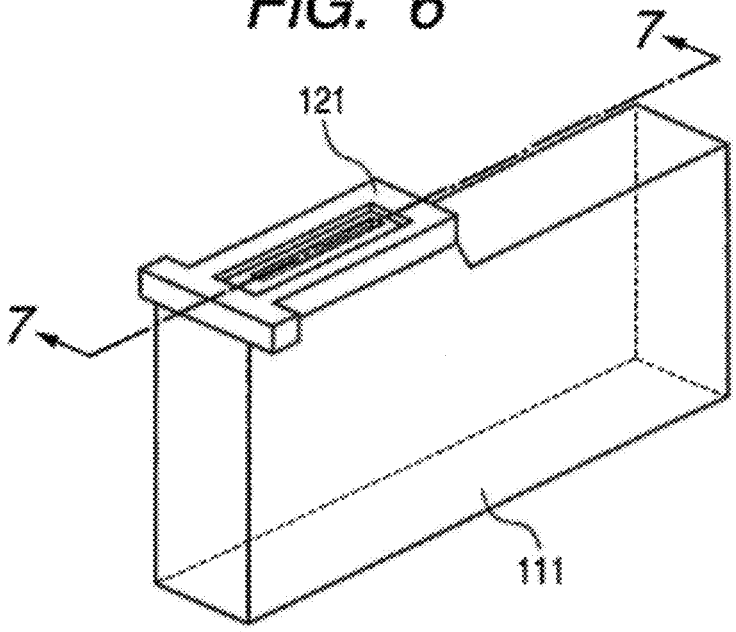
FIG. 6 is a schematic perspective view of a recording head according to an embodiment of the present invention.
Figure 7:
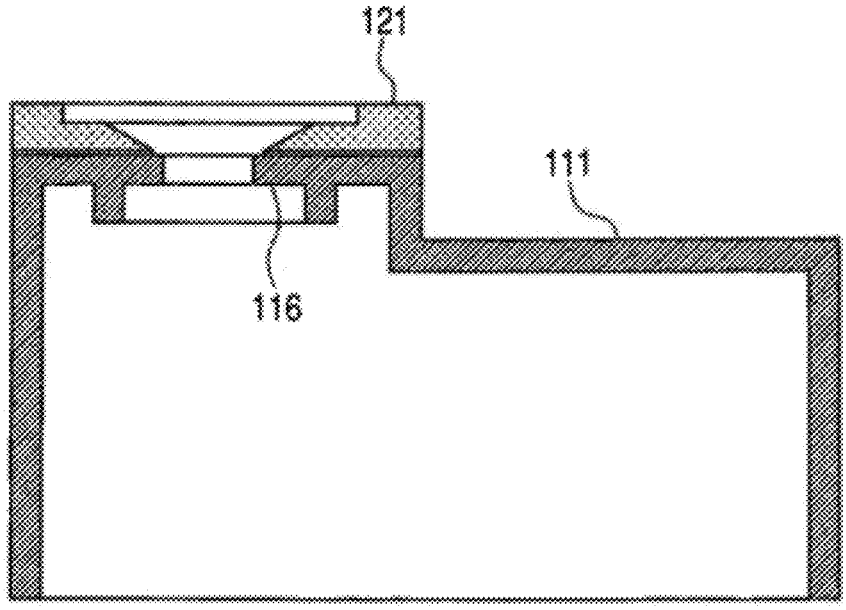
FIG. 7 is a schematic sectional view of one part of a recording head according to an embodiment of the present invention.

First, as illustrated in FIG. 1A, the support member 121 is disposed in a depression 113 of the ink supply member 116 which forms ink supply channels 112. The support member 121 is positioned so that the openings 123 of the support member 121 correspond to the ink supply channels 112. The ink supply channels 112 are partitioned by intermediate walls 115 of the ink supply member 116. In this embodiment, an ink jet recording head of a structure having three ink supply channels 112 that allow different types of ink to be supplied is illustrated. Note that the support member 121 need not necessarily be disposed in the depression 113 which is a hollow area of the ink supply member 116. The support member 121 may be disposed in an area of the ink supply member 116 with no depression, as illustrated in FIGS. 6 and 7.

FIG. 1B illustrates a structure of bonding the support member 121 and the discharge element substrate 131 together. The discharge element substrate 131 connected to the printed wiring substrate 135 is placed in the depression 113 of the main body unit 111 so that the openings 123 of the support member 121 correspond to ink supply port openings 132 of the discharge element substrate 131. This creates a structure in which the ink supply channels 112, the openings 123, and the ink supply port openings 132 are directly communicated with each other. In such a structure, drive control signals are supplied to heaters (not illustrated) as energy generating elements that are provided on an upper surface of the discharge element substrate 131 and generate energy used for discharging a liquid, through the printed wiring substrate 135. This causes each heater to generate heat. At this time, ink introduced into the ink supply port openings 132 of the discharge element substrate 131 through the ink supply channels 112 is heated and forms a bubble due to a film boiling phenomenon, and is discharged from an ink discharge port 133 toward a recording surface of a recording medium as the bubble expands.

Here, even when the discharge element substrate 131 expands due to the heat of each heater (not illustrated), a deformation can be suppressed because the support member 121 has a similar linear expansion coefficient to the discharge element substrate 131.

Moreover, a joint surface 134 of the discharge element substrate 131 is bonded to the joint surface 122 of the support member 121 by an adhesive 141. Here, flatness of the joint surface 122 of the support member 121 is preferably not more than 20 μm. Such flatness allows for the use of screen printing which is a simple adhesive coating method, so that the discharge element substrate can be accurately joined by pressing the discharge element substrate 131 against the joint surface 122 so as to follow the flatness of the joint surface 122. This prevents a loss of ink impact accuracy during discharge. The adhesive 141 desirably has a low viscosity and a low curing temperature, cures in a short time, exhibits relatively high hardness after curing, and also is resistant to ink.

Figure 9A:
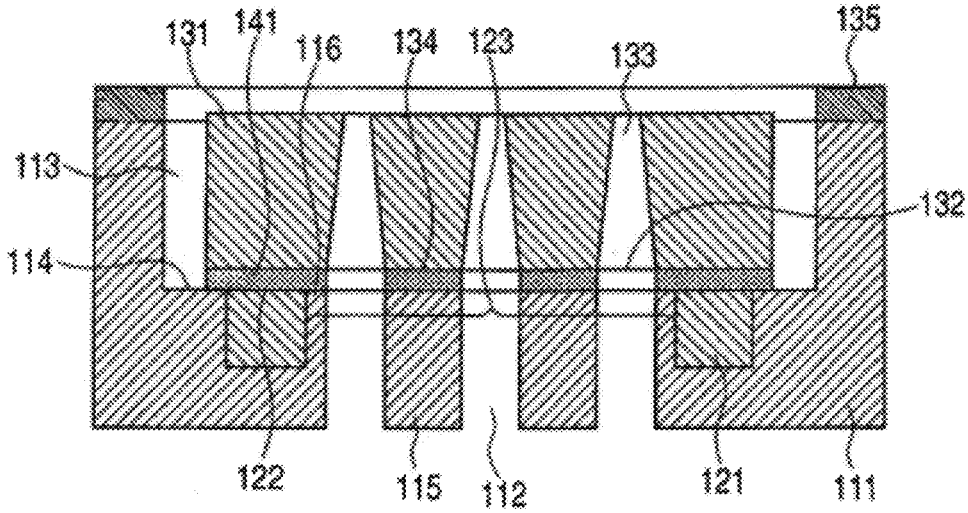
FIGS. 9A and 9B are schematic sectional views of one part of a recording head according to an embodiment of the present invention.

FIG. 9A illustrates an embodiment in which the support member illustrated in FIG. 2B is used, by the same section as in FIGS. 1A and 1B. In this embodiment, the support member 121 is provided so that one opening 123 corresponds to the plurality of ink supply channels 112, that is, the plurality of ink supply channels 112 is formed in an area of the main body unit 111 corresponding to the opening 123. Accordingly, the support member 121 is embedded in an area of the main body unit 111 around the ink supply channels 112 excluding the intermediate walls 115. Thus, the support member 121 is molded integrally with the main body unit 111 without contacting ink in the ink supply channels 112.

The discharge element substrate 131 connected to the printed wiring substrate 135 is placed in the depression 113 of the main body unit 111 so that the ink supply channels 112 of the main body unit 111 correspond to the ink supply openings 132 of the discharge element substrate 131. The joint surface 134 of the discharge element substrate 131 is bonded to the joint surface 122 of the support member 121 by the adhesive 141. In the intermediate walls 115, since the support member 121 is not formed in this area, the discharge element substrate 131 and the main body unit 111 are bonded to each other by the adhesive 141.

Figure 9B:
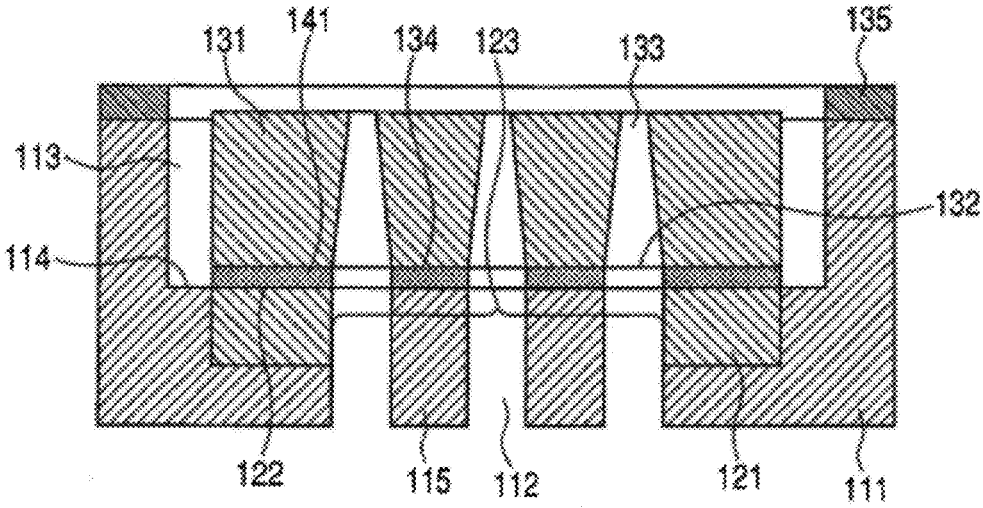

FIG. 9B illustrates another embodiment in which the support member illustrated in FIG. 2B is used.

In FIG. 9B, the support member 121 is formed integrally with the main body unit 111, in the area of the main body unit 111 around the ink supply channels 112 excluding the intermediate walls 115. Here, the support member 121 is provided so that one opening 123 corresponds to the plurality of ink supply channels 112, that is, the plurality of ink supply channels 112 of the main body unit 111 is formed inside the opening 123.

Figure 4:
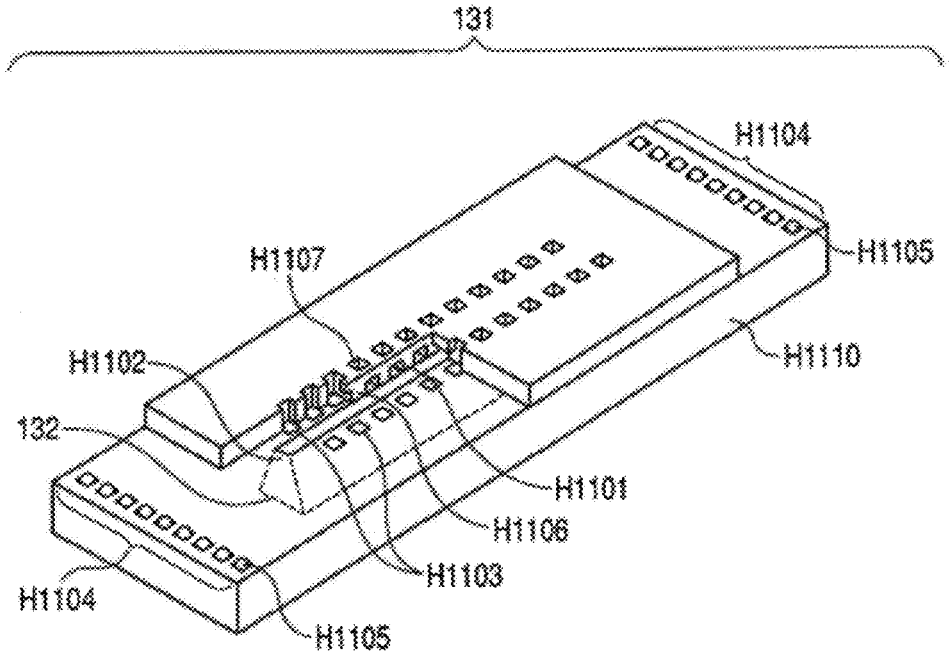
FIG. 4 is a schematic perspective view of a discharge element substrate used in a recording head according to an embodiment of the present invention.

The following describes an example of the discharge element substrate 131 with reference to FIG. 4. FIG. 4 is a schematic view illustrating an example of the discharge element substrate 131. In this embodiment, a size of the discharge element substrate 131 is 2 mm to 3 mm in width, 25 mm to 35 mm in length (in a discharge port direction), and 0.5 mm to 0.8 mm in thickness. The discharge element substrate includes a substrate H1110 having energy generating elements H1103 that generate energy used for discharging a liquid, and discharge ports H1107 for discharging ink. An ink supply port H1102 having the ink supply port opening 132 communicated with the opening 123 of the support member 121 is provided in the substrate H1110. Moreover, an electrode unit H1104 having bumps H1105 electrically connected to the energy generating elements H1103 is disposed on the Si substrate, and the electrode unit H1104 is connected to the printed wiring substrate 135. Further, an ink flow channel wall H1106 forms a flow channel H1101 that communicates between the supply port H1102 and the discharge ports H1107.

In the present invention, the support member 121 is preferably formed of a polymer alloy. It is particularly desirable that the ink supply member 116 is formed of a first resin, and the support member 121 contains a polymer alloy which is a mixture of the first resin and a second resin different from the first resin.

Examples of the first resin forming the ink supply member 116 are modified PPE (polyphenylene ether), PS (polystyrene), HIPS (high impact polystyrene), and PET. In consideration of wettability, dimensional stability upon molding, and rigidity, modified PPE (polyphenylene ether) is preferable. The modified PPE resin (modified polyphenylene ether resin) is also suitable in the case of integrally molding the ink supply member 116 and the ink tank. Though the supply member can also contain the second resin, there are cases where the supply member preferably does not contain the second resin. For instance, it may be difficult to accurately mold detailed parts of the supply member depending on a resin material required as the second resin.

On the other hand, the resin forming the support member 112 needs to have resistance to heat generated from the discharge element substrate, in addition to wettability. This being so, polystyrene, PPS (polyphenylene sulfide), an acrylic resin, HIPS (high impact polystyrene), PP (polypropylene), PE (polyethylene), nylon, PSF (polysulfone), and the like can be contained as the resin. In particular, the PPS resin (polyphenylene sulfide resin) is suitable as it can be easily molded even when a large amount of filler capable of reducing a linear expansion coefficient is contained. It is preferable to use such a material as the second resin and form the support member 121 of an alloy of the second resin and a material having a high affinity for the ink supply member 116. It is especially preferable to form the support member using a polymer alloy of the second resin and the same resin as the first resin forming the ink supply member. In this case, the support member preferably contains a larger amount of the first resin. As an alternative, an alloy of the first resin and a metal such as magnesium may be used.

As a result, the support member that functions as a support for holding the substrate and also has a high affinity for the ink supply member can be obtained integrally with the ink supply member. In particular, it is preferable to integrally mold the ink supply member and the support member, by using modified PPE for the ink supply member and a polymer alloy of PPS and modified PPE for the support member.

Here, the support member may further contain a third resin for enhancing the affinity for the ink supply member, such as a polyethylene copolymer copolymerized with an epoxy compound.

Filling the support member with the filler enables the linear expansion coefficient to be decreased. A material that decreases a linear expansion coefficient of a resin, for example an inorganic filler such as a glass filler, a carbon filler, spherical silica, spherical alumina, mica, and talc, is usable as the filler. When filling with the filler, it is preferable to use a spherical filler which is composed of spherical particles, in terms of surface flatness and also in terms of prevention of an anisotropic expansion coefficient. In addition, a particle diameter of the filler is preferably small. A linear expansion coefficient of a discharge element substrate ((silicon substrate)+(resin flow channel)) typically used for a liquid discharge head is 3 ppm. To approach this linear expansion coefficient, a high filler content is preferable. It is desirable to combine two or more types of filler with different particle diameters as the filler, so that filling a gap of large particles with a small particle is repeatedly performed to reduce voidage and thereby increase a filling factor. For instance, when 75% to 85% by weight a spherical filler with an average particle diameter of 30 μm and 15% to 25% by weight a spherical filler with an average particle diameter of 6 μm are used, high-density filling can be achieved. By containing the filler in a proportion of 80% by weight to the support member, the linear expansion coefficient of the support member can be sufficiently decreased, and the difference in linear expansion coefficient from the discharge element substrate can be sufficiently reduced. In the case of containing the filler in a proportion of 80% by weight to the support member, by using PPS in the support member in a proportion of not less than 3.8% by weight and preferably in a proportion of not less than 5% by weight to the filler, the support member can exhibit extremely high fluidity during molding.

In relation to a recording head manufacturing method, an example method of forming the support member 121 is described below. In a manufacturing method of the support member 121, first a support member material is kneaded and pelletized. When doing so, in the case where the support member raw material contains not less than 75% by mass the filler, a kneading device capable of applying a strong shear force under a high temperature is preferably used. For example, when using the open roll continuous extruder "Kneadex" (trade name: produced by Mitsui Mining Co., Ltd.), by supplying the support member raw material to this device, it is possible to continuously perform from kneading to pelletization.

Next, pellets are poured into a mold of a predetermined shape using a molding machine, and the support member is manufactured by injection molding. At this time, in the case where the support member material has a high filler content and low fluidity, a high-speed, high-pressure molding machine capable of pouring the support member material at high speed is employed. While an injection speed of an ordinary molding machine is about 500 mm/sec, an injection speed of 1500 mm/sec to 2000 mm/sec can be obtained with a high-speed, high-pressure molding machine. As molding conditions, an injection speed of not less than 1000 mm/sec and an injection pressure of not less than 300 MPa are preferable in order to enhance the filling property.

A mold temperature at the time of molding is in a range from (Tg −30)° C. to Tg° C. inclusive, where Tg is a glass transition temperature of the above-mentioned thermoplastic resin. By setting the mold temperature in this temperature range, a deformation of the support member 121 which occurs at the time of mold release can be suppressed, and the fluidity and adhesion of the resin can be ensured. This is also preferable since the flatness of the joint surface 134 of the recording element substrate 131 can be increased.

Moreover, it is desirable that a time period (hereafter referred to as cooling time) from when the injection of the support member material ends to when the molded support member is removed from the mold is set to not less than 60 seconds, and the mold temperature at the time of removal is set in a range from (Tg −30)° C. to Tg° C. inclusive. Note that Tg is the glass transition temperature Tg (° C.) of the above-mentioned thermoplastic resin. By setting the cooling time to not less than 60 seconds, the deformation of the support member 121 which occurs at the time of mold release can be suppressed, and the flatness of the support member 121 can be made to not more than 20 μm. As an example, Tg of modified PPE which is a polymer alloy of PPE and PS usable for the thermoplastic resin of the present invention is about 110° C., depending on the ratio of PPE and PS in modified PPE.

Figure 5A:
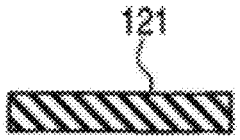
FIGS. 5A and 5B are schematic sectional views of one part of a recording head according to an embodiment of the present invention.
Figure 5B:
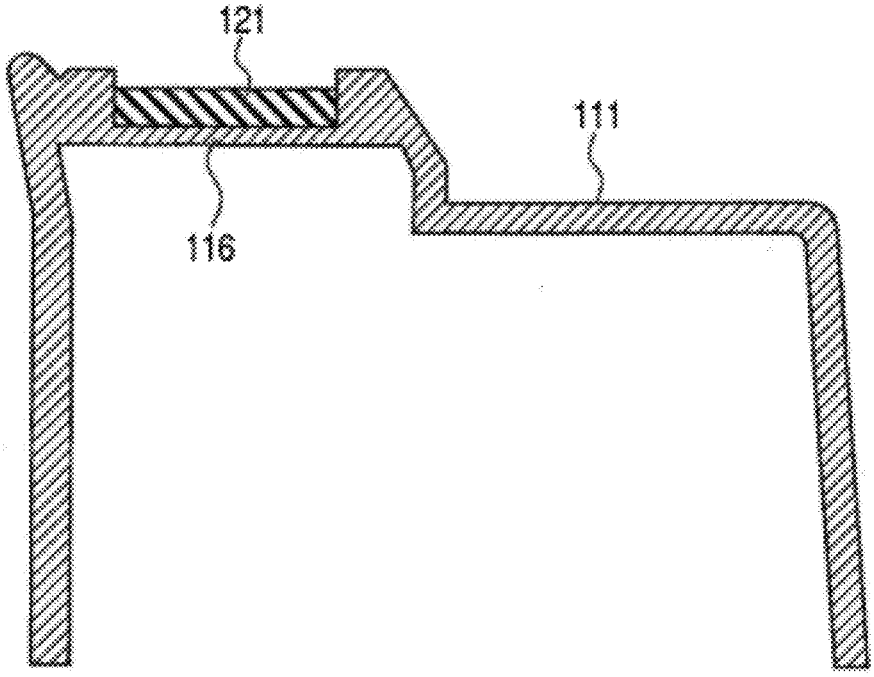

As illustrated in FIG. 5A, in a state where the support member 121 is placed and fixed in a mold of the main body unit 111, a material for forming the ink supply member 116 and the main body unit 111 is injection molded. When doing so, the joint surfaces of the ink supply member 116 and the support member 121 are fused together, creating a state illustrated in FIG. 5B. This is an integral molding method generally called insert molding, and enables the support member 121 to be securely joined to the main body unit 111. Here, a mold surface of the mold used for insert molding, that corresponds to the joint surface 122 of the support member 121, preferably has flatness of not more than 5 μm.

Figure 8A:
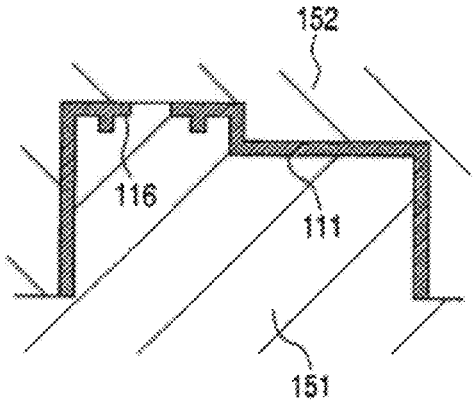
FIGS. 8A, 8B, 8C and 8D are schematic sectional views illustrating a molding procedure of a recording head according to an embodiment of the present invention.
Figure 8C:
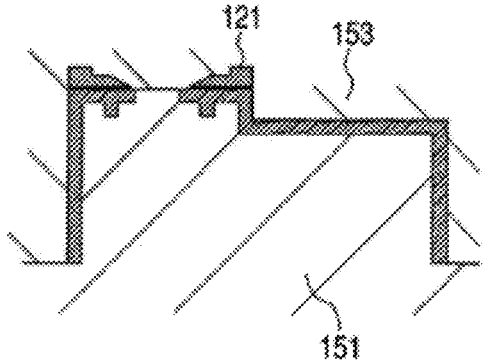
Figure 8B:
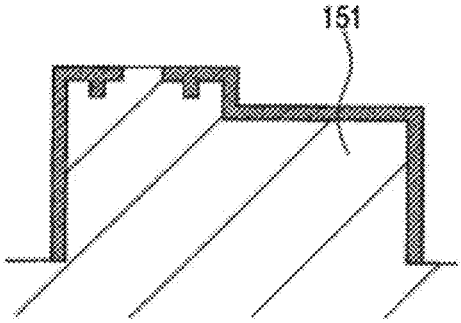
Figure 8D:
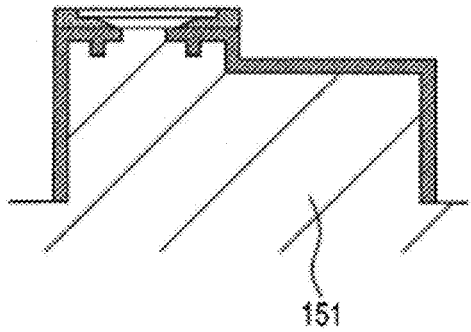

The support member 121 and the ink supply member may be formed according to other molding methods. One example is described below. FIG. 6 is a schematic view illustrating one part of a recording head which is an embodiment of the present invention, and FIG. 7 is a sectional view taken along line 7-7. The support member 121 made of the mixture material of the first resin and the second resin is joined to the ink supply member 116 and the main body unit 111 made of the first resin. FIGS. 8A to 8D illustrate a molding procedure. In FIG. 8A, the first resin is injection molded using a first mold 151 and a second mold 152, to form the ink supply member 116 and the main body unit 111. Next, the second mold 152 is removed as illustrated in FIG. 8B. At this time, the ink supply member 116 and the main body unit 111 are left in a state of being fixed to the first mold 151. Further, as illustrated in FIG. 8C, a third mold 153 for forming the support member 121 is joined to the first mold 151 to which the ink supply member 116 and the main body unit 111 are left fixed, and injection molding is performed by injecting the mixture material of the first resin and the second resin. When doing so, the joint surfaces of the ink supply member 116 and the support member 121 are fused together. After this, as illustrated in FIG. 8D, the third mold 153 is removed, and the molded object is taken out. This is an integral molding method generally called two-color molding, and has an advantage of easily achieving relative dimensional accuracy between the support member 121 and the ink supply member 116 and the main body unit 111. In this case too, the above-mentioned preferable molding conditions of the support member, such as the mold temperature upon the injection of the support member, can be applied according to need.

The support member is further described below, from a thermal point of view.

Making the discharge element substrate long contributes to an improved recording speed. When scanning the liquid discharge head to perform recording in the recording apparatus, it is desirable to reduce the number of scans in order to improve the recording speed. In view of this, a discharge element substrate of about 25 mm to 40 mm is often used. An excessively long discharge element substrate is considered to be difficult in terms of manufacture.

The following describes thermal capacity of the support member. The thermal capacity indicates the amount of heat required to increase the temperature of the object by 1° C. When the discharge element substrate is about 25 mm to 40 mm, the thermal capacity of the support member is preferably 2.5 J/K to 3.9 J/K. A total amount of thermal energy generated by applying an electrical pulse to drive the energy generating elements increases as the discharge element substrate becomes longer. This being so, if the support member carrying the discharge element substrate has appropriate thermal capacity, thermal energy can be transferred from the discharge element substrate to the support member. This suppresses heat accumulation in the discharge element substrate, and contributes to stable discharge. In terms of manufacture, on the other hand, for example in the case of injection molding the support member, the thermal capacity is preferably not more than 3.9 J/K in order to prevent an increase in cooling time. When the thermal capacity is not more than 3.9 J/K, the cooling time after injection molding is about 30 seconds. Thus, the advantage of injection molding can be exploited to achieve inexpensive and simple manufacture.

In addition, the flatness of the support member is preferably not more than 20 μm. This flatness allows the long discharge element substrate to be supported horizontally, and contributes to favorable discharge.

Moreover, in addition to establishing appropriate thermal capacity, thermal conductivity is desirably 0.5 W/(m·K) to 1.5 W/(m·K). When the thermal conductivity is not less than 0.5 W/(m·K), the transfer of thermal energy to the support member can be made more smoothly. Additionally, it is possible to suppress detrimental effects that are expected to occur in, for example, insert molding. In insert molding, there is the case where, when the material injected to form the ink supply member touches the already inserted support member, if the support member has high thermal conductivity, the material of the ink supply member rapidly loses heat and is singly cooled to a solid. Accordingly, when joining the support member and the ink supply member by insert molding, it is especially preferable that the thermal conductivity of the support member is not more than 1.5 W/(m·K).

The following shows Examples to describe the present invention in detail.

EXAMPLE 1

The support member integrated with the ink supply member was manufactured in the following way.

First, the support member 121 was manufactured as follows. PPS (produced by Tosoh Corporation; SUSTEEL B-060P), modified PPE (produced by SABIC Corporation; SE1-X), and spherical silica with an average particle diameter of 30 μm (produced by MICRON Co. Ltd.) were kneaded in a weight ratio of 8/2/90 at a resin temperature of 280° C. to 290° C., to produce pellets. This material was molded in the mold of the support member 121 under conditions of an injection speed of 1500 mm/s, an injection pressure of 343 MPa, a resin temperature of 320° C., a mold temperature of 100° C., and a cooling time of 60 sec. As a result, the support member as illustrated in FIG. 2A was obtained.

Next, the obtained support member 121 was inserted in the mold of the main body unit 111 and the ink supply unit 116 beforehand, and a modified PPE (produced by SABIC Corporation; SE1-X) resin was poured into the mold to perform insert molding. Molding conditions of the main body unit 111 were an injection speed of 70 mm/s, an injection pressure of 65 MPa, a resin temperature of 320° C., and a mold temperature of 100° C. The support member is 13 mm long, 9 mm wide, and 1 mm thick, and has three openings which are 9.5 mm long and 0.5 mm wide, respectively at a center thereof.

As a result, the molded object integrating the support member 121, the ink supply unit 116, and the main body unit was obtained.

Following this, the discharge element substrate having the Si substrate provided with the flow channel formation member and the discharge port of the resin was prepared, and the Si surface of the discharge element substrate opposite to the discharge port surface was bonded to the support member 121 of the molded object by the adhesive. Note that the discharge element substrate has a width of 4.3 mm, a length of 11.7 mm, and a thickness of 0.65 mm.

In this way, the recording head was obtained.

EXAMPLE 2

The recording head was manufactured in the same way, except that the weight ratio of PPS (produced by Tosoh Corporation), modified PPE (produced by SABIC Corporation), and spherical silica (produced by MICRON Co. Ltd.) as the material of the support member 121 was changed to 9.6/6.4/84.

EXAMPLE 3

The recording head was manufactured in the same way as Example 1, except that the weight ratio of PPS (produced by Tosoh Corporation), modified PPE (produced by SABIC Corporation), and spherical silica (produced by MICRON Co. Ltd.) was changed to 16/4/80.

EXAMPLE 4

The recording head was manufactured in the same way as Example 1, except that the weight ratio of PPS (produced by Tosoh Corporation), modified PPE (produced by SABIC Corporation), and spherical silica (produced by MICRON Co. Ltd.) was changed to 12/8/80.

EXAMPLE 5

The recording head was manufactured in the same way as Example 1, except that the weight ratio of PPS (produced by Tosoh Corporation), modified PPE (produced by SABIC Corporation), and spherical silica (produced by MICRON Co. Ltd.) was changed to 10/10/80.

EXAMPLE 6

The recording head was manufactured in the same way as Example 1, except that the weight ratio of PPS (produced by Tosoh Corporation), modified PPE (produced by SABIC Corporation), and spherical silica (produced by MICRON Co. Ltd.) was changed to 8/12/80.

EXAMPLE 7

The recording head was manufactured in the same way as Example 1, except that the weight ratio of PPS (produced by Tosoh Corporation), modified PPE (produced by SABIC Corporation), and spherical silica (produced by MICRON Co. Ltd.) was changed to 4/16/80.

EXAMPLE 8

The recording head was manufactured in the same way as Example 1, except that the weight ratio of PPS (produced by Tosoh Corporation), modified PPE (produced by SABIC Corporation), and spherical silica (produced by MICRON Co. Ltd.) was changed to 3/17/80.

EXAMPLE 9

The recording head was manufactured in the same way as Example 1, except that the weight ratio of PPS (produced by Tosoh Corporation), modified PPE (produced by SABIC Corporation), and spherical silica (produced by MICRON Co. Ltd.) was changed to 2.5/22.5/75.

EXAMPLE 10

The recording head was manufactured in the same way as Example 1, except that polymer alloy PPS (produced by Tosoh Corporation; SUSTEEL 301-066) and spherical silica (produced by MICRON Co. Ltd.) were kneaded in a weight ratio of 20/80.

EXAMPLE 11

The recording head was manufactured in the same way as Example 1, except that the weight ratio of PPS (produced by Tosoh Corporation), modified PPE (produced by SABIC Corporation), and spherical silica (produced by MICRON Co. Ltd.) was changed to 6/24/70.

EXAMPLE 12

First, a modified PPE (produced by SABIC Corporation; SE1-X) resin was poured to mold the main body unit 111, at an injection speed of 70 mm/s, an injection pressure of 65 MPa, a resin temperature of 320° C., and a mold temperature of 100° C.

Next, PPS (produced by Tosoh Corporation; SUSTEEL B-060P), modified PPE (produced by SABIC Corporation; SE1-X), and spherical silica (produced by MICRON Co. Ltd.) were kneaded in a weight ratio of 8/2/90 at a resin temperature of 280° C. to 290° C., to produce pellets. This material was submitted to mold the support member 121 in the state where the main body unit 111 was left in the mold, under conditions of an injection speed of 1500 mm/s, an injection pressure of 343 MPa, a resin temperature of 320° C., a mold temperature of 100° C., and a cooling time of 60 sec.

As a result, the molded object integrating the support member 121, the ink supply member 116, and the main body unit was obtained. Subsequently, the recording head was manufactured in the same way as Example 1.

EXAMPLE 13

First, the support member was manufactured in the same way as Example 6. The differences from Example 6 lie in the following. The surface of the support member on which the discharge element substrate is mounted has a plane of 34 mm×4 mm, and has a tapered opening that is 28.5 mm×1 mm on the discharge element substrate side and 30 mm×1 mm on the supply member side. The flatness was 9 μm when measured with a laser three-dimensional measuring machine. In addition, the support member has a thickness of 4 mm, a mass of 8 g, a density of 1.88 g/cm$^3$, and thermal capacity of 3.5 J/K. Thermal conductivity and specific heat of the pellets before manufacturing the support member were measured to be 0.8 W/(m·K) and 0.817 J/(K·g), respectively. Note that the specific heat [J/(K·g)] was measured by a DSC method in accordance with JIS K 7123. The thermal capacity [J/K] was calculated from a product of the specific heat [J/(K·g)] measured earlier and the mass [g] of the support member measured with an electronic balance, according to the following formula: ((thermal capacity [J/K])=(specific heat [J/(K·g)])×(mass [g])). Meanwhile, the thermal conductivity [W/(m·K)] was measured by a laser flash method.

Further, the recording head was manufactured in the same way as Example 6, except for the following differences from Example 6. The discharge element substrate joined to the support member has a width of 1.2 mm, a length of 33 mm, and a thickness of 0.7 mm. In addition, the discharge element substrate has 600 nozzles capable of discharging 30 pl.

EXAMPLE 14

The recording head was manufactured in the same way as Example 13, except that the mounted discharge element substrate has a width of 1.2 mm, a length of 25 mm, and a thickness of 0.7 mm.

EXAMPLE 15

The recording head was manufactured in the same way as Example 13, except that the mounted discharge element substrate has a width of 1.2 mm, a length of 40 mm, and a thickness of 0.7 mm.

EXAMPLE 16

The recording head was manufactured in the same way as Example 13, except that the support member has a thickness of 4.5 mm. The flatness of the support member measured 12 μm, and the thermal capacity of the support member measured 3.9 J/K.

EXAMPLE 17

The support member was manufactured in the same way as Example 6, except that the weight ratio of PPS, modified PPE, and spherical silica was changed to 20/30/50. The thermal conductivity of the pellets was 0.5 W/(m·K), the flatness of the support member was 20 μm, and the thermal capacity of the support member was 2.5 J/K.

Further, the recording head was manufactured in the same way as Example 13.

EXAMPLE 18

The differences from Example 13 lie in the following. As the material of the support member, PPS, modified PPE, and spherical alumina with an average particle diameter of 30 μm (produced by MICRON Co. Ltd.) were kneaded in a mass ratio of 8/12/80. The thickness of the support member was set to 2.5 mm. Apart from these, the recording head was manufactured in the same way as Example 13.

COMPARATIVE EXAMPLE 1

The recording head was manufactured in the same way as Example 1, except that the weight ratio of PPS (produced by Tosoh Corporation), modified PPE (produced by SABIC Corporation), and spherical silica (produced by MICRON Co. Ltd.) was changed to 20/0/80.

COMPARATIVE EXAMPLE 2

PPS (produced by Idemitsu Co. Ltd., NAC-117) was used for the support member 121, and molded in the mold of the support member 121 under molding conditions of an injection speed of 1500 mm/s, an injection pressure of 343 MPa, a resin temperature of 350° C., a mold temperature of 80° C., and a cooling time of cooling up to a mold temperature of 50° C. Note that the material used for the support member contains a fibrous filler as a filler. The molding conditions of the main body unit 111 were the same as Example 1.

EXAMPLE 19

The recording head was manufactured in the same way as Example 13, except that the thickness of the support member was changed to 2.5 mm. The flatness of the support member was 8 μm, and the thermal capacity of the support member was 2.2 J/K.

<Test>

After causing the plurality of recording heads of the Examples and Comparative Examples to undergo the following temperature cycle, the discharge element substrate and its vicinity were observed. The observation of the vicinity was conducted by filling yellow ink for greater visibility and paying attention to the joint between the substrate and the support member and the peeling between the support member and the supply member. When compared with the test (1), the test (2) involves a violent temperature change, and so can be considered as a test under severe conditions.

(Test (1): High/Low Temperature Cycle Test)

The head was observed after performing the following process 10 times: 2 hours of room temperature (25° C.)→2 hours of low temperature (−30° C.)→2 hours of room temperature (25° C.)→2 hours of high temperature (60° C.)

(Test (2): High/Low Temperature Shock Test)

The head was observed after performing the following process 10 times: 2 hours of high temperature (60° C.)⇆2 hours of low temperature (−30° C.)

(Test (3): Material Flow Test)

The head was observed after being left for 360 hours in an environment of a temperature of 60° C. and a humidity of 20%. In this test, the head which has experienced the above-mentioned temperature and humidity was installed in the recording apparatus and a plurality of color ink was provided to record an image.

<Evaluation>

Table 1 shows results of observing the discharge element substrate for the Examples and Comparative Examples.

<Evaluation Criteria>

(Between the Substrate and the Support Member)

A: There is no peeling between the discharge element substrate and the support member. In addition, there is no warpage of the discharge element substrate.

B: There is no peeling between the discharge element substrate and the support member. Though the discharge element substrate has warpage in rare cases, the warpage is small and does not affect discharge.

C: There is no peeling between the discharge element substrate and the support member. In some cases, the discharge element substrate has warpage to an extent that affects when discharging a very small droplet.

D: Damage such as a fracture is seen in part of the discharge element substrate, or the discharge element substrate is peeled away from the support member.

(Between the Support Member and the Supply Member)

A: There is no peeling between the support member and the supply member.

B: There is small peeling between the support member and the supply member in very rare cases.

D: There is frequent peeling between the support member and the supply member.

(Fluidity)

A: Continuously from initial molding, the support member having an excellent molding accuracy can be molded.

B: After some number of molding, the support member having an excellent molding accuracy can be continuously molded.

-: Not evaluated.

TABLE 1

| (support member) | | Example (No.) 1 | 2 | 3 | 4 | 5 | 6 | 7 | 8 | 9 | 10 | 11 | 12 | Comp. Ex. 1 | 2 |
|---|---|---|---|---|---|---|---|---|---|---|---|---|---|---|---|
| PPS [wt %] | | 8 | 9.6 | 16 | 12 | 10 | 8 | 4 | 3 | 2.5 | — | 6 | 8 | 20 | used |
| modified PPE [wt %] | | 2 | 6.4 | 4 | 8 | 10 | 12 | 16 | 17 | 22.5 | — | 24 | 12 | | not used |
| PPS + polyetherene copolymer [wt %] | | | | | | | | | | | 20 | | | | |
| spherical silica filler [wt %] | | 90 | 84 | 80 | 80 | 80 | 80 | 80 | 80 | 75 | 80 | 70 | 80 | 80 | |
| fibrous filler | | | | | | | | | | | | | | | used |
| fludity | | A | A | A | A | A | A | A | B | B | A | A | A | — | — |
| test (1) | between substrate and support member | A | A | A | A | A | A | A | A | A | A | B | A | A | B |
| | between support member and supply member | A | A | A | A | A | A | A | A | A | A | A | A | D | D |
| test (2) | between substrate and support member | A | A | A | A | A | A | A | A | B | A | C | A | A | C |
| | between support member and supply member | B | B | B | B | A | A | A | A | A | B | A | A | D | D |
| test (3) | between substrate and support member | A | A | A | A | A | A | A | A | A | A | A | A | D | D |
| | between support member and supply member | A | A | A | A | A | A | A | A | A | A | A | A | D | D |

Table 1 demonstrates the following.

In the evaluation between the substrate and the support member in the test (1), extremely favorable results were obtained in all Examples. In the evaluation between the substrate and the support member in the test (2) which is a stricter test, extremely excellent results were obtained in Examples 1 to 8, and 11 and 12 where the filler content in the support member is not less than 80% by weight. From these results, it can be understood that the peeling between the substrate and the support member is suppressed especially when the filler content in the support member is not less than 80% by weight. This can be attributed to that the linear expansion coefficient of the support member is closer to that of the substrate.

Moreover, in the evaluation between the support member and the supply member, extremely favorable results were obtained in all Examples in the test (1). On the other hand, peeling occurred between the support member and the supply member in the heads of the Comparative Examples. In the test (2) which is stricter than the test (1), Examples 5 to 9 and 11 to 12 differ from the other Examples. More favorable results were obtained in Examples 5 to 9 and 11 to 12 than the other Examples. From these results, it can be understood that it is especially preferable to contain modified PPE, which is the material for forming the ink supply member, in a proportion of not less than 50% by weight in the resin components of the support member except the filler (Examples 5 to 9 and 11 to 12). That it, the weight of polyphenylene ether is preferably not less than the weight of polyphenylene sulfide.

Furthermore, in terms of the fluidity of the support member during molding, when the filler in the support member is not less than 80% by weight, it is preferable to use PPS in a proportion of not less than 5% by weight to the filler. This is because the fluidity evaluation was more favorable in Examples 1 to 7 where PPS is contained in the support member in a proportion of not less than 5% by weight to the filler, than in Examples 8 and 9 where PPS is contained in a proportion of not more than 5% by weight to the filler. These results indicate that, in the resin components except the filler, the amount of PPS affects the fluidity and the amount of PPE affects the affinity between the support member and the supply member.

Examples 5 to 7 showed extremely favorable results in all of the evaluations between the substrate and the support member and between the support member and the supply member in the tests (1) to (3). As can be understood from this, it is particularly preferable that the filler content in the support member is not less than 80% by weight, PPS is contained in a proportion of not less than 5% by weight to the filler, and the proportion of modified PPE in the resin components except the filler is not less than 50% by weight.

In the discharge results in the test (3), a favorable recorded image was obtained with no lines or unevenness, in the recording heads of all Examples. On the other hand, image distortion occurred in the recording heads of the Comparative Examples. This can be attributed to that different colors of ink were mixed together due to the peeling between the support member and the supply member.

(Temperature Rise Evaluation)

Each of the recording heads according to Examples 13 to 19 was installed in the recording apparatus, and the temperature of the discharge element substrate when continuously discharging ink for 30 seconds with a discharge frequency of 5000 Hz was measured with a diode sensor and evaluated. Table 2 shows the results.

A: Less than 50.1° C.

B: Not less than 50.1° C.

TABLE 2

| | filler type | content in support member (mass %) | thermal capacity (J/K) | length of discharge element substrate (mm) | achieving temperature (° C.) | evaluation |
|---|---|---|---|---|---|---|
| Example 13 | spherical silica | 80 | 3.5 | 33 | 40 | A |
| Example 14 | spherical silica | 80 | 3.5 | 25 | 38 | A |
| Example 15 | spherical silica | 80 | 3.5 | 40 | 47 | A |
| Example 16 | spherical silica | 80 | 3.9 | 33 | 39 | A |
| Example 17 | spherical alumina | 80 | 2.9 | 33 | 42 | A |
| Example 18 | spherical silica | 50 | 2.5 | 33 | 44 | A |
| Example 19 | spherical silica | 80 | 2.2 | 33 | 56 | B |

According to the table, the thermal capacity differs between Example 13 and Example 16, due to the difference in thickness. When comparing Examples 13 to 18 with Example 19, by setting the thermal capacity of the support member to not less than 2.5 J/K, the temperature rise when discharge is continuously performed with a long discharge element substrate of 25 mm or more can be limited to a relatively low temperature of not more than 47° C.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2008-134315, filed May 22, 2008, 2008-170441, filed Jun. 30, 2008, 2009-064299, filed Mar. 17, 2009, and 2009-076767, filed Mar. 26, 2009, which are hereby incorporated by reference herein in their entirety.

The invention claimed is:

1. A liquid discharge head comprising:

a discharge element substrate including a substrate provided with an energy generating element that generates energy for discharging a liquid;

a supply member formed of a material that contains a first resin, and having a supply channel for supplying the liquid to the discharge element substrate; and a support member formed of a material that contains a mixture of the same resin as the first resin and a second resin having a different structural formula from the first resin, and molded between the supply member and the discharge element substrate so as to be integral with the supply member.

2. The liquid discharge head according to claim 1, wherein the support member contains a filler.

3. The liquid discharge head according to claim 1, wherein the second resin is a polyphenylene sulfide resin.

4. The liquid discharge head according to claim 3, wherein the support member contains a filler in a proportion of not less than 80% by weight to the support member, and wherein the polyphenylene sulfide resin is contained in the support member in a proportion of not less than 5% by weight to the filler.

5. The liquid discharge head according to claim 1, wherein the first resin is a modified polyphenylene ether resin.

6. The liquid discharge head according to claim 1, wherein the first resin is a modified polyphenylene ether resin, wherein the second resin is a polyphenylene sulfide resin, and wherein in the support member, a weight of the modified polyphenylene ether resin is not less than a weight of the polyphenylene sulfide resin.

7. The liquid discharge head according to claim 1, wherein thermal capacity of the support member is in a range from 2.5 J/K to 3.9 J/K inclusive.

8. The liquid discharge head according to claim 1, wherein flatness of a surface of the support member facing the discharge element substrate is not more than 20 μm.

9. The liquid discharge head according to claim 8, wherein the support member contains a filler.

10. The liquid discharge head according to claim 8, wherein the second resin is a polyphenylene sulfide resin.

11. The liquid discharge head according to claim 10, wherein the support member contains a filler in a proportion of not less than 80% by weight to the support member, and wherein the polyphenylene sulfide resin is contained in the support member in a proportion of not less than 5% by weight to the filler.

12. The liquid discharge head according to claim 8, wherein the first resin is a modified polyphenylene ether resin.

13. The liquid discharge head according to claim 8, wherein the first resin is a modified polyphenylene ether resin, wherein the second resin is a polyphenylene sulfide resin, and wherein in the support member, a weight of the modified polyphenylene ether resin is not less than a weight of the polyphenylene sulfide resin.

14. A liquid discharge head comprising:

a discharge element substrate including a substrate provided with an energy generating element that generates energy for discharging a liquid;

a supply member formed of a material that contains a first resin, and having a supply channel for supplying the liquid to the discharge element substrate; and a support member containing a mixture that contains a second resin and a third resin, and molded between the supply member and the discharge element substrate so as to be integral with the supply member, the second resin having a different structural formula from the first resin, and the third resin having a different structural formula from each of the first resin and the second resin.

15. The liquid discharge head according to claim 14, wherein the first resin is a modified polyphenylene ether resin, wherein the second resin is a polyphenylene sulfide resin, and wherein the third resin is a polyethylene copolymer copolymerized with an epoxy compound.

16. A liquid discharge head comprising:

a discharge element substrate including a substrate provided with an energy generating element that generates energy for discharging a liquid;

a supply member formed of a material that contains a first resin, and having a supply channel for supplying the liquid to the discharge element substrate; and a support member containing a mixture that contains the same resin as the first resin and a second resin different from the first resin, and disposed between the supply member and the discharge element substrate.

* * * * *